US005320652A

United States Patent [19]

Akel et al.

[11] Patent Number: 5,320,652

[45] Date of Patent: Jun. 14, 1994

[54] STEAM SEPARATING APPARATUS

[75] Inventors: H. Rodolfo Akel, Suffield, Conn.; John M. Banas, Warren; Brian P. DeMarey, Bondsville, both of Mass.; Gary W. Gralton, East Granby; Bard C. Teigen, Enfield, both of Conn.

[73] Assignee: Combustion Engineering, Inc., Windsor, Conn.

[21] Appl. No.: 89,888

[22] Filed: Jul. 12, 1993

[51] Int. Cl.[5] ..... B01D 53/26

[52] U.S. Cl. ..... 55/320; 55/332; 55/442; 55/440

[58] Field of Search ..... 55/320, 321, 332, 440, 55/442

[56] References Cited

U.S. PATENT DOCUMENTS

| | | | |
|---|---|---|---|
| 2,895,566 | 7/1959 | Coulter | 55/440 |
| 3,358,580 | 12/1967 | Freese et al. | 55/440 |
| 3,953,183 | 4/1976 | Regehr | 55/440 |
| 5,271,753 | 12/1993 | Akel et al. | 55/440 |

FOREIGN PATENT DOCUMENTS

| | | | |
|---|---|---|---|
| 946909 | 1/1964 | United Kingdom | 55/320 |

*Primary Examiner*—Tim Miles

*Attorney, Agent, or Firm*—Chilton, Alix & Van Kirk

[57] ABSTRACT

A liquid-vapor separator for two-phase fluids in general and specifically a steam-water separator in a steam drum of a steam generator includes axial or radial spinner blades to create a centrifugal motion which causes liquid to be forced outward against the outer wall and the vapor to be concentrated in the center. Conical extraction skimmers systematically extract and discharge the liquid outwardly and downwardly through the side walls such that it impinges on an optional discharge screen surrounding the skimmers. The vapor flows out the top through a central opening and enters a secondary separator packed with crimped wire mesh encased in a perforated enclosure. The conical extraction skimmers include an outwardly protruding rim portion which forms an enlarged annular chamber between the rim and the underlying conical extraction skimmer. This forms a converging-diverging flow path out between skimmer sections and an outwardly extending ring forms a tortuous path. Inwardly extending extraction lips of varying size on the top of each skimmer enhance the liquid extraction.

10 Claims, 3 Drawing Sheets

STEAM SEPARATING APPARATUS

BACKGROUND OF THE INVENTION

This invention relates to the field of separating vapors from liquids in two-phase mixtures such as separating steam from water in a boiler or natural gas from liquid hydrocarbons. More particularly, the invention relates to steam drum internals for separating steam from water.

Steam generated in a subcritical pressure drum type boiler is intimately mixed with large and variable amounts of circulating boiler water. Before the steam leaves the boiler and enters the superheater, practically all of this associated water must be separated from the steam. This separation must be done within a limited space in the steam drum, within a matter of seconds and under a variety of velocity, pressure and other operating condition. The pressure drop across the steam and water separators must be kept to a minimum so as not to affect the boiler circulation or water level controls. Despite many theoretical analyses of steam and water separation and a great number of hypotheses to explain these phenomena, steam and water separation in boilers retains many aspects of an art and has thus far defied complete mathematical representation.

Nearly all of the liquid and solid impurities in the steam and water mixture must be separated from the steam before it is suitable for use. Any unseparated liquid in the steam contains dissolved and suspended salts which appear as a solids impurity in the steam when the moisture is evaporated in the superheater or it is directed to a turbine or other steam driven apparatus.

The drum of a subcritical pressure boiler serves several functions, the first being that of collecting the mixture of water and steam discharged from the boiler circuits. Also, the drum houses equipment to separate the steam from the water and then purify the steam after it has been separated. The drum internals in subcritical pressure boilers not only separate water from steam but also direct the flow of water and steam to establish an optimum distribution of fluids in the boiler during all loads of boiler operation. The internals may consist of baffles which change the direction of flow of a steam and water mixture, impellers and separators which use a spinning action for removing water from steam or moisture coalescers such as screen and corrugated plate final dryers. These devices are used singly or in consort to separate and purify the steam and remove impurities from the steam leaving the boiler drum.

The space required to accommodate steam separating and purifying equipment determines drum size. Drum diameter and length should be sufficient to provide accessibility for installation and inspection and for processing the maximum flows of water and steam. Providing sufficient drum diameter and length to provide this accessibility while still maintaining a drum of a reasonable size is a significant challenge to the designer of drum internals.

SUMMARY OF THE INVENTION

It is therefore an object of the present invention to provide a vapor separating apparatus which will afford efficient and effective separation and drying within a minimum space and with a relatively low pressure loss. More particularly, the present invention relates to a primary separator including means for imparting centrifugal motion to the mixture and skimmers to capture liquid thrown to the outside and direct the liquid downwardly and out the sides. The arrangement of skimmers provides a converging and diverging tortuous path to separate and coalesce liquid droplets. A discharge screen may be included to reduce the velocity of the discharged liquid, release vapor from the surface of the droplets and minimize disruption of the liquid pool. Also, a secondary separator may follow the primary separator. The invention is particularly applicable to the separation of steam from water and separating and purifying other vapors from two-phase mixtures such as liquid and gaseous hydrocarbons.

DESCRIPTION OF THE PREFERRED EMBODIMENT

Although the invention is applicable to the separation of various liquid-vapor mixtures as previously stated, the invention will be described with particular reference to steam drums and the separation of water and steam.

Figure 1:
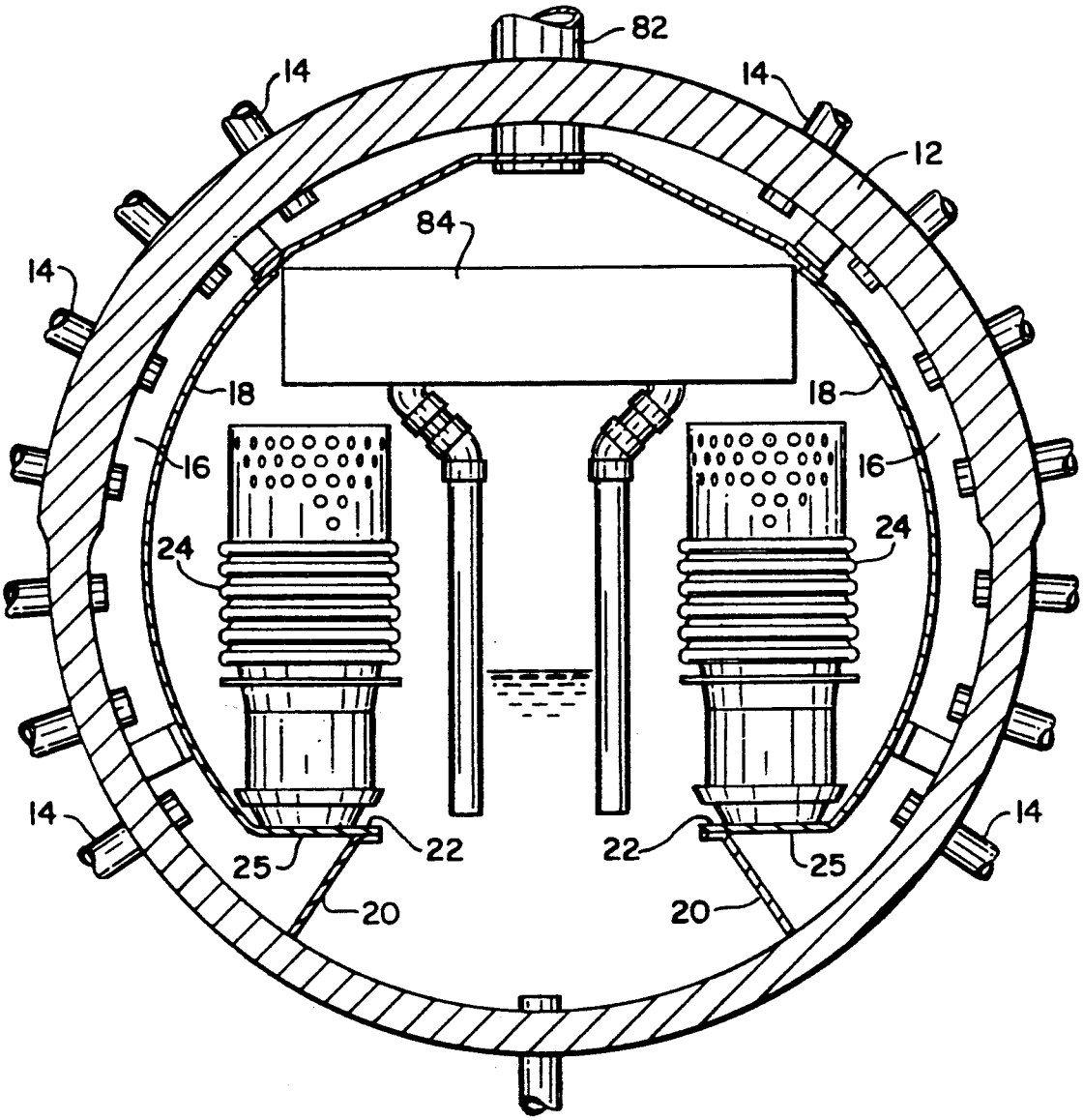
FIG. 1 is a vertical cross-sectional view of a steam drum incorporating the separator of the present invention.

Referring specifically to FIG. 1 of the drawings, the drum 12 is a conventional steam drum configuration with an elongated cylindrical shape and disposed with its axis parallel to the horizontal. The drum 12 is penetrated by riser pipes 14 which receive the steam/water mixture from the steam generator and discharge this mixture into the annular space 16 between the drum liner or baffle 18 and the drum 12. Although the riser pipes 14 have been illustrated as being distributed rather uniformly around the annular space 16, the actual sections of the drum penetrated by the risers is a variable that depends on the drum operating pressure, the type of furnace circulation and the mass loading of steam and water into the drum. The baffle 18 is closed off at the bottom ends by the baffle portions 20 and the baffle includes the horizontal ledge portions 22. This baffle 18 including its portions 20 and 22 extends the full length of the drum thereby providing the enclosed annular space 16.

Mounted on the baffle ledge portions 22 are a plurality of steam separating units 24 in two horizontally extending rows on either side of the axis of the drum. Although two rows have been illustrated, there may be more than two. Each row would contain as many separators as desired and would be dependent on the drum size and capacity. The steam separators 24 are mounted over apertures 25 in the baffle ledge portions 22 thereby directing the flow of the steam-water mixture from the pipes 14 into the annular space 16 and then up through the apertures 25 in the baffle ledge portions 22 and into the interior of the separators 24.

Figure 2:
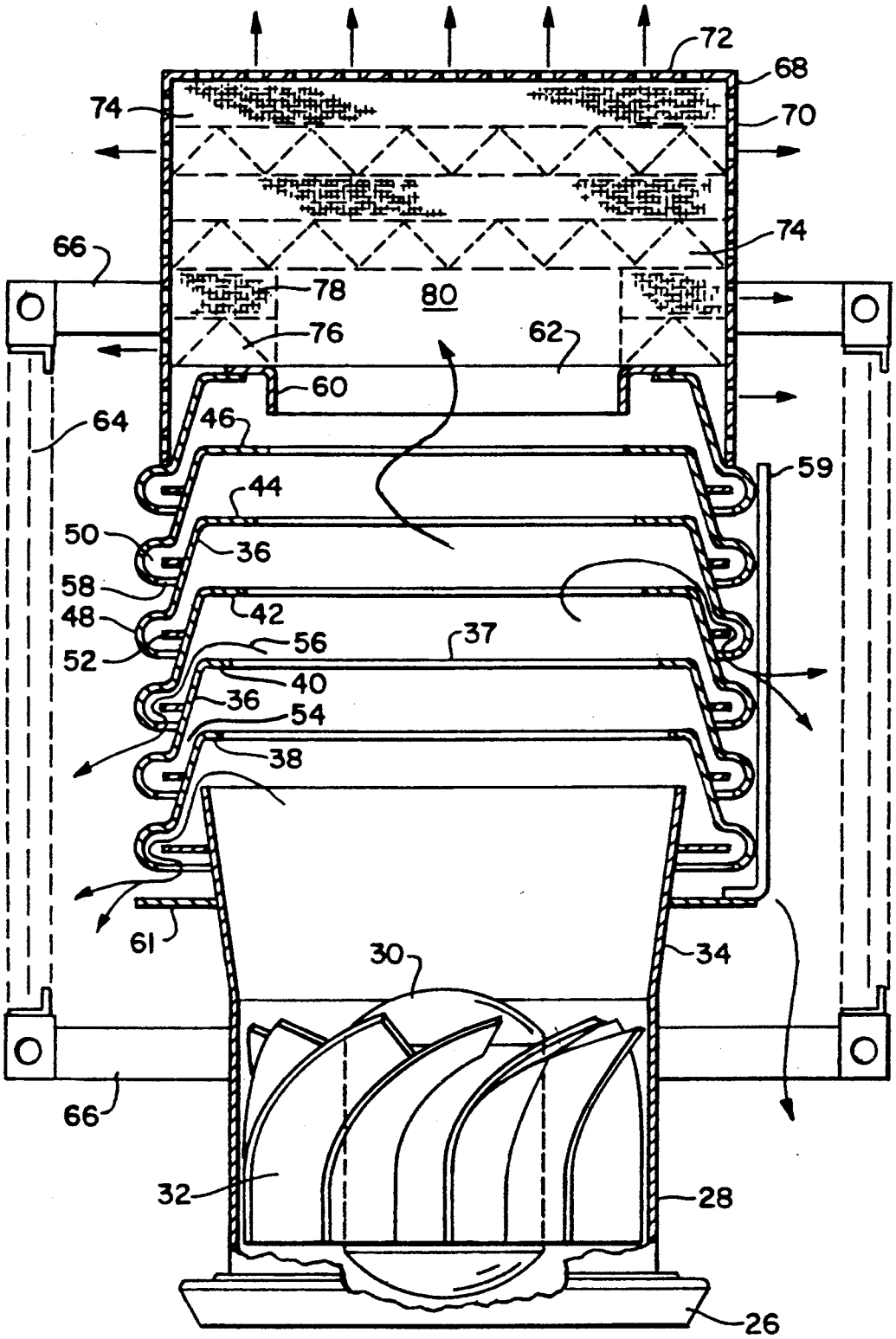
FIG. 2 is a vertical cross section view of the separator.
Figure 3:
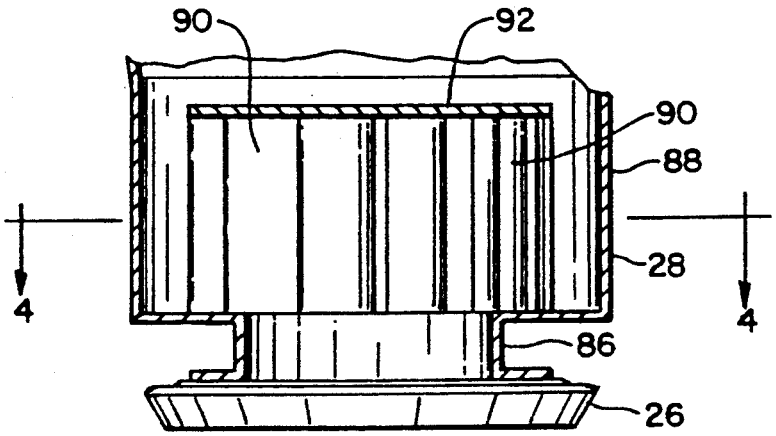
FIG. 3 is a vertical cross section view of an alternate spinner portion of the separator.
Figure 4:
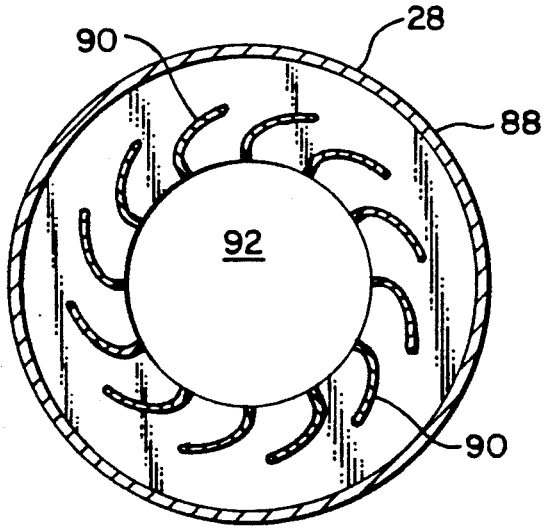
FIG. 4 is a cross section view taken along line 4—4 of FIG. 3.

Referring now to FIG. 2, the base of the separator is a cast steel support ring 26 with the circular spinner housing 28 welded on top. Contained within the housing 28 is a core 30 which is a cylindrical member having domed top and bottom ends. The bottom domed end has a hole for pressure equalization. Located in the annular space between the core 30 and the housing 28 are the spinner blades 32. These spinner blades 32 are welded to the core 30 and to the housing 28 to form a unitary spinner unit. The profiles and discharge angles of the spinner blades 32 can be optimized to enhance the centrifugal motion of the steam/water mixture. The profile and discharge angle of the blades depends on the composition and thermophysical properties of the liquid-vapor mixture being separated. FIG. 3 and 4 illustrate an alternate form of spinner that could be used in the separator. Although the details may vary for any specific situation, the shapes illustrated for the spinner housing and blade configuration are only by way of example and the invention is not limited to any specific dimensions or angles. The centrifugal motion imparted to the mixture causes liquid to be forced against the outer wall of the separator and the vapor to move to the center.

Attached to the top of the spinner housing 28 is a conical diffuser section 34 which has a larger diameter at the top than the bottom. This diffuser section reduces the momentum of the separated mixture as it travels upward because of the increased cross-sectional flow area. This loss of momentum further enhances the separation. The diameter and height of the diffuser section are optimized depending upon the mixture being separated and the separation of hydrocarbons or other vapor-liquid mixtures may require a different diameter and height.

Located above the diffuser section 34 are a series of formed liquid extraction skimmers 36. These extraction skimmers are generally conical in shape with the major central portion of the upper surface being open to form the aperture 37 and the remaining extraction lips 38 to 46. These extraction lips 38 to 46 are in the form of annular inwardly extending portions which protrude into the two-phase flow and tend to trap the liquid droplets as they flow up along the inside surface of the separator. The size of these extraction lips and the amount that they intrude into the flow path increases in the direction of flow as seen in FIG. 2. This tends to spread the liquid extraction over the full height of the primary separator and assure that the maximum amount of liquid has been extracted. The number of extraction skimmers varies depending on the mass flow rate being processed, on the ratio of liquid and vapor present and on the thermophysical properties of the mixture being separated. The drawing shows six skimmers for illustrative purposes only.

The liquid which is removed by each extraction lip then flow down and out between adjacent skimmers. The extraction skimmers are shaped as shown in FIG. 2 to form a converging-diverging path as well as a tortuous path for the extracted liquid-vapor mixture as it flows out between the adjacent skimmers. Each skimmer 36 has an outwardly protruding rim portion 48 which, in cooperation with the underlying skimmer, forms an annular flow chamber 50. Extending into these annular flow chambers 50 are the annular ribs or rings 52 attached around the underlying skimmer. The rib 52 for the bottom skimmer is attached to the diffuser section 34. This rib 52 thus forms a tortuous flow path for the liquid. Also, this shape provides a throat or narrow portion 54 between adjacent extraction skimmers. As the fluid flows towards this throat as indicated by the arrow 56, there is a convergence. Then, as the fluid flows down through the chamber 50 around the rib 52 and out the bottom opening 58, there is a divergence. The combination of the tortuous path and the convergence-divergence promotes contact and coalescence of any residual steam bubbles in the liquid. The coalesced bubbles are thus more likely to disengage from the liquid pool in the drum rather than be carried down with recirculated water. The converging-diverging tortuous path also reduces the velocity of the liquid exiting from between the skimmers which diminishes the steam carry under into the water pool in the bottom of the drum. Each extraction skimmer 36 is supported by a plurality of support bars 59 spaced around and attached to each skimmer and supported on the bottom annular ring 61.

Surrounding the extraction skimmers 36 is an optional water discharge screen 64. This discharge screen may be formed from a variety of materials such as woven wire mesh, unwoven wire mats or perforated plates. The discharge screen 64 is mounted between the brackets 66 spaced around the unit. The lower brackets are attached to the spinner housing 28 and the upper brackets are attached to the secondary separator to be described hereinafter. The use of the discharge screen is optional and will primarily depend upon whether or not there is sufficient space in the drum.

The liquid droplets flowing downward and outward from the extraction skimmers 36 tend to be thrown against this water discharge screen 64. The discharge screen confines the water streams and further reduces their velocity. This minimizes disruption of the liquid pool in the bottom of the drum and reduces re-entrainment of vapor into the liquid water. Furthermore, it minimizes the entrainment of vapor in the liquid water since vapor tends to be released upon impact with the discharge screen.

Attached on top of the uppermost extraction skimmer 36 is a cap or cover 60 which has a central opening 62. This forms an annular barrier to the upward flow of water along the wall while providing a central opening for the upward flow of vapor.

The vapor which has thus far been separated from the liquid flows up through the opening 62 in the cap or cover 60 and enters the secondary separator section 68. This secondary separator section has a perforated cylindrical container 70 and a round perforated cover 72. Stacked inside the container 70 are layers of crimped wire mesh 74 with each layer being oriented with respect to the adjacent layer such that the crimps are perpendicular as shown in FIG. 2. The bottom layers of wire mesh (two layers 76 and 78 are illustrated) are open in the center and "donut" shaped. This forms an open central area 80. This central vapor inlet area enhances the vapor flow distribution into the secondary separator. The residual liquid that is carried into the secondary separator is coalesced and deposited on the packed mesh and flows down through the mesh where it is discharged primarily from the bottom periphery of the secondary separator. The vapor flows up and out the perforations in the container 70 and cover 72.

The vapor (steam) coming from the tops of the separators 24 enters the vapor space around and above the separators and flows upward toward the steam outlet 82 shown in FIG. 1. Between the separators 24 and the steam outlet 82 is the final steam dryer generally designated as 84. Final steam dryers are conventional and any desired design may be used in conjunction with the separators of the present invention. Therefore, the specific details of the final steam dryer have not been described.

Referring to FIGS. 3 and 4, a portion of a separator is illustrated with a modified spinner design. The base of the separator is a cast steel support ring 26 with the circular spinner housing 28 welded on top. This spinner housing has a narrow throat section 86 and an enlarged section 88. Mounted within the enlarged section over the throat section are the profiled radial spinner blades 90. The configuration of these spinner blades is shown in FIG. 4. The tops of the spinner blades are covered by the plate 92. It can be seen that the liquid-vapor mixture that enters up through the throat section 86 will be forced radially outward with a spinning motion. This will produce a centrifugal motion as the mixture moves upwardly. This centrifugal motion causes the liquid to be forced out against and up the wall and the vapor to move to and up through the center of the separator. From that point, the separator is constructed and operates in the same way as the first embodiment.

While certain embodiments of the present invention have been shown and described, these are intended to be by way of example and are not intended to limit the scope of the invention as claimed.

We claim:

1. A vapor-liquid mixture separator comprising a. a base having a central inlet in the bottom of said separator;

b. a circular housing attached to and extending upwardly from said base;

c. spinner means located within said circular housing and over said central inlet adapted to cause a vapor-liquid mixture flowing up through said central inlet to spin outwardly and upwardly whereby vapor and liquid are separated and the liquid from said vapor-liquid mixture is thrown to the outside and the vapor is concentrated in the center of said circular housing;

d. a plurality of extraction skimmer sections supported above said circular housing, each extraction skimmer section comprising a conical section having a large lower diameter and a smaller upper diameter and with the large lower diameter of each conical section extending partially down over the smaller upper diameter of the conical section below forming a restricted flow portion therebetween whereby separated liquid along the outside is thrown outwardly and downwardly through said restricted flow portion between adjacent skimmer sections; and whereby said separated vapor flows up through the central portions of said extraction skimmers and out the top, the improvement comprising:

i. said larger lower diameter of each of said extraction skimmers including an outwardly protruding rim portion forming an enlarged annular chamber between said rim portion and said conical section below, said enlarged annular chamber being open at the bottom whereby said flow enters said enlarged annular chamber from said restricted flow portion and flows out the bottom;

ii. an outwardly extending ring attached to each extraction skimmers positioned to extend outwardly into said enlarged annular chamber to form a tortuous converging-diverging flow path for said flow; and iii. an inwardly extending extraction lip extending inwardly from the top portion of each extraction skimmer into the flow path of liquid flowing upwardly inside said extraction skimmer to intercept and extract said liquid into said restricted flow portion, said inwardly extending extraction lip on each extraction skimmer being larger and extending further inwardly than the one below.

2. A vapor-liquid mixture separator as recited in claim 1 and further including a secondary separator mounted on top of said separator above said central outlet.

3. A vapor-liquid mixture separator as recited in claim 2 wherein said secondary separator contains a plurality of layers of crimped wire mesh.

4. A vapor-liquid mixture separator as recited in claim 3 wherein said layers of crimped wire mesh are oriented with said crimps in each layer being perpendicular to said crimps in adjacent layers.

5. A vapor-liquid mixture separator as recited in claim 2 wherein said secondary separator is contained within a perforated plate cylinder.

6. A vapor-liquid mixture separator as recited in claim 2 wherein said secondary separator contains a plurality of layers of material for separating liquid droplets from vapor and includes at least one bottom layer in the form of an annular ring having an open center and at least one top layer extending over said bottom annular ring layer and said open center.

7. A vapor-liquid mixture separator as recited in claim 6 wherein said material for extracting liquid comprises crimped wire mesh and wherein said layer of crimped wire mesh is oriented with said crimps in each layer being perpendicular to said crimps in adjacent 8. A vapor-liquid mixture separator as recited in claim 1 wherein said spinner means comprises:

a. a central core located in the center of said circular housing forming an annular flow channel between said central core and said circular housing;

b. a plurality of spinner blades spaced generally uniformly around said annular flow channel and attached between said central core and said circular housing; said spinner blades having bottom portions extending generally vertically and upper portions being bent at an angle thereto whereby flow of said vapor-liquid mixture is caused to spin axially upward through said annular flow channel.

9. A vapor-liquid mixture separator as recited in claim 8 and further including a conical diffuser section attached to the top of said circular housing above said annular flow channel and diverging outwardly whereby the flow area for said axially spinning mixture is increased.

10. A vapor-liquid mixture separator as recited in claim 1 wherein said spinner means comprises:

a. a central open area in said circular housing;

b. a plurality of spinner blades spaced generally uniformly around said central open area and spaced inwardly from said circular housing, said spinner blades extending generally radially outward in a spiral pattern, said spinner blades and said central open area being closed at the top whereby flow of said vapor-liquid mixture is caused to spin radially outward towards and around said circular housing.

* * * * *

UNITED STATES PATENT AND TRADEMARK OFFICE

CERTIFICATE OF CORRECTION

PATENT NO. : 5,320,652

DATED : June 14, 1994

INVENTOR(S) : H. Rodolfo Akel et al

It is certified that error appears in the above-indentified patent and that said Letters Patent is hereby corrected as shown below:

Claim 7, column 6, line 34, after "adjacent" insert --layers.--.

Signed and Sealed this

Twentieth Day of September, 1994

*Attest:*

*Attesting Officer*

Bruce Lehman

BRUCE LEHMAN

*Commissioner of Patents and Trademarks*